US011299337B2

(12) United States Patent
O'Donnell et al.

(10) Patent No.: US 11,299,337 B2
(45) **Date of Patent: *Apr. 12, 2022**

(54) FLEXIBLE PACKAGES WITH FLAT PANELS

(71) Applicant: The Procter & Gamble Company, Cincinnati, OH (US)

(72) Inventors: Hugh Joseph O'Donnell, Cincinnati, OH (US); Edward Daniel Theiss, III, Union Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/987,989

(22) Filed: May 24, 2018

(65) Prior Publication Data

US 2018/0339832 A1 Nov. 29, 2018

Related U.S. Application Data

(60) Provisional application No. 62/510,397, filed on May 24, 2017.

(51) Int. Cl.

| | |
|---|---|
| ***B65D 81/05*** | (2006.01) |
| ***B65D 37/00*** | (2006.01) |
| ***B65D 33/02*** | (2006.01) |
| ***B65D 57/00*** | (2006.01) |
| ***B65D 75/52*** | (2006.01) |

(52) U.S. Cl.

CPC ..... *B65D 81/054* (2013.01); *B65D 33/02* (2013.01); *B65D 37/00* (2013.01); *B65D 57/00* (2013.01); *B65D 75/52* (2013.01); *B65D 2203/00* (2013.01); *B65D 2501/24777* (2013.01)

(58) Field of Classification Search

CPC ..... B65D 81/054; B65D 37/00; B65D 33/02; B65D 57/00; B65D 75/52; B65D 2501/24777; B65D 2203/00

USPC ..... 206/449; 383/119

See application file for complete search history.

(56) References Cited

U.S. PATENT DOCUMENTS

| | | | |
|---|---|---|---|
| 4,076,121 | A | 2/1978 | Clayton et al. |
| 4,288,965 | A | 9/1981 | James et al. |
| 4,532,753 | A | 8/1985 | Kovacs |
| 4,903,841 | A | 2/1990 | Ohsima et al. |
| 4,965,126 | A | 10/1990 | Abraham et al. |
| 5,139,832 | A | 8/1992 | Hayashi et al. |
| 5,229,180 | A | 7/1993 | Littmann |
| 5,352,043 | A | 10/1994 | Takagaki et al. |
| 5,984,088 | A | 11/1999 | Dietz et al. |

(Continued)

FOREIGN PATENT DOCUMENTS

| | | | |
|---|---|---|---|
| CN | 1301289 | A | 6/2001 |
| CN | 1309067 | A | 8/2001 |

(Continued)

OTHER PUBLICATIONS

Office Actions for U.S. Appl. No. 15/935,397.

(Continued)

*Primary Examiner* — J. Gregory Pickett
*Assistant Examiner* — Jenine Pagan
(74) *Attorney, Agent, or Firm* — Daniel S. Albrecht; Jason Jeffrey Camp

(57) ABSTRACT

Flexible packages with reinforcing areas and flat panels.

20 Claims, 3 Drawing Sheets

(56) References Cited

U.S. PATENT DOCUMENTS

| | | | | |
|---|---|---|---|---|
| 6,149,227 | A | 11/2000 | Wycech | |
| 6,520,333 | B1 | 2/2003 | Tschantz | |
| 6,729,112 | B2 | 5/2004 | Kuss et al. | |
| 7,448,495 | B2 | 11/2008 | Sadow | |
| 9,403,617 | B2 | 8/2016 | Schneider et al. | |
| 9,695,586 | B1 | 7/2017 | Reading | |
| 9,908,285 | B2 | 3/2018 | Nam et al. | |
| 10,151,304 | B2 | 12/2018 | Felton et al. | |
| 10,549,896 | B2 | 2/2020 | O'donnell | |
| 10,562,684 | B2 | 2/2020 | Exner et al. | |
| 10,926,930 | B2 | 2/2021 | O'donnell et al. | |
| 2001/0005979 | A1 | 7/2001 | Kuss et al. | |
| 2002/0006485 | A1* | 1/2002 | Bening | B32B 27/08 428/35.4 |
| 2002/0094434 | A1 | 7/2002 | Zhou et al. | |
| 2003/0002755 | A1 | 1/2003 | Kim et al. | |
| 2004/0058118 | A1 | 3/2004 | Fink | |
| 2005/0147329 | A1 | 7/2005 | Arvizu | |
| 2005/0152624 | A1 | 7/2005 | Versluys | |
| 2005/0199692 | A1 | 9/2005 | Nelson et al. | |
| 2007/0184238 | A1 | 8/2007 | Hockaday et al. | |
| 2007/0251942 | A1 | 11/2007 | Cole et al. | |
| 2008/0011753 | A1 | 1/2008 | Browne et al. | |
| 2008/0233320 | A1 | 9/2008 | Fink et al. | |
| 2008/0272117 | A1* | 11/2008 | Roos | A45C 7/0077 220/6 |
| 2009/0047477 | A1* | 2/2009 | Roys | B29C 51/14 428/156 |
| 2009/0200294 | A1 | 8/2009 | Maxwell et al. | |
| 2009/0311190 | A1 | 12/2009 | Gracias et al. | |
| 2010/0159218 | A1 | 6/2010 | Yum | |
| 2010/0260941 | A1 | 10/2010 | Bushmire et al. | |
| 2010/0291352 | A1 | 11/2010 | Jager | |
| 2010/0301512 | A1 | 12/2010 | Rousseau et al. | |
| 2010/0326985 | A1 | 12/2010 | Lin | |
| 2011/0038571 | A1 | 2/2011 | Moehlenbrock | |
| 2011/0052106 | A1 | 3/2011 | Holmes et al. | |
| 2011/0097019 | A1 | 4/2011 | Moehlenbrock et al. | |
| 2011/0135884 | A1 | 6/2011 | Lettow et al. | |
| 2011/0176753 | A1* | 7/2011 | Nowak | B65D 33/004 383/116 |
| 2011/0203229 | A1 | 8/2011 | Exner et al. | |
| 2012/0135237 | A1 | 5/2012 | Gracias et al. | |
| 2012/0230614 | A1 | 9/2012 | Reichert et al. | |
| 2012/0306189 | A1* | 12/2012 | Stewart | G06K 19/086 283/67 |
| 2013/0045530 | A1 | 2/2013 | Gracias et al. | |
| 2013/0095258 | A1 | 4/2013 | Gracias et al. | |
| 2013/0195382 | A1 | 8/2013 | Murray | |
| 2013/0210148 | A1 | 8/2013 | Gracias et al. | |
| 2013/0292049 | A1 | 11/2013 | Schindler, II | |
| 2014/0033655 | A1 | 2/2014 | Stanley et al. | |
| 2014/0117588 | A1 | 5/2014 | Schindler, II et al. | |
| 2014/0199002 | A1 | 7/2014 | Murray | |
| 2014/0224697 | A1* | 8/2014 | Oostwouder | B65D 31/12 206/459.5 |
| 2014/0305036 | A1 | 10/2014 | Pretsch et al. | |
| 2014/0318591 | A1 | 10/2014 | Shelby et al. | |
| 2015/0059288 | A1 | 3/2015 | Wu | |
| 2015/0122842 | A1* | 5/2015 | Berg, Jr. | B65D 75/008 222/173 |
| 2015/0266639 | A1 | 9/2015 | Mcdonald et al. | |
| 2015/0284144 | A1 | 10/2015 | Dytchkowskyj | |
| 2015/0307264 | A1* | 10/2015 | Boswell | B65B 61/16 206/484.2 |
| 2016/0040657 | A1 | 2/2016 | Felton et al. | |
| 2016/0107812 | A1 | 4/2016 | Exner et al. | |
| 2016/0137374 | A1 | 5/2016 | Brosch et al. | |
| 2016/0152402 | A1* | 6/2016 | Su | B65D 57/00 220/592.24 |
| 2016/0176584 | A1* | 6/2016 | Ishihara | B65D 35/02 493/243 |
| 2016/0207704 | A1* | 7/2016 | Schneider | F01M 11/0004 |
| 2016/0297589 | A1* | 10/2016 | You | B65D 75/52 |
| 2017/0259961 | A1 | 9/2017 | O'Donnell et al. | |
| 2017/0259971 | A1 | 9/2017 | O'Donnell et al. | |
| 2017/0259972 | A1 | 9/2017 | O'Donnell et al. | |
| 2018/0282041 | A1 | 10/2018 | O'Donnell et al. | |
| 2018/0317314 | A1 | 11/2018 | Olberding et al. | |
| 2018/0339822 | A1 | 11/2018 | O'Donnell et al. | |
| 2018/0339823 | A1 | 11/2018 | Rogers et al. | |

FOREIGN PATENT DOCUMENTS

| | | | |
|---|---|---|---|
| CN | 1319539 | A | 10/2001 |
| CN | 2855927 | Y | 1/2007 |
| CN | 101663209 | A | 3/2010 |
| CN | 202686913 | U | 1/2013 |
| CN | 102991835 | A | 3/2013 |
| CN | 103108808 | A | 5/2013 |
| CN | 103803174 | A | 5/2014 |
| CN | 105916775 | A | 8/2016 |
| CN | 105934390 | A | 9/2016 |
| EP | 0620156 | | 10/1994 |
| EP | 0681970 | | 11/1995 |
| EP | 0997391 | | 5/2000 |
| EP | 1059243 | A2 | 12/2000 |
| EP | 1454837 | A1 | 9/2004 |
| EP | 1970310 | B1 | 11/2009 |
| EP | 2156947 | A1 | 2/2010 |
| EP | 2360099 | B1 | 7/2015 |
| FR | 2990686 | | 11/2013 |
| JP | H09272564 | A | 10/1997 |
| JP | 2004299779 | | 10/2004 |
| WO | WO2017156367 | A1 | 9/2017 |

OTHER PUBLICATIONS

Office Actions for U.S. Appl. No. 15/988,035.

Office Actions for U.S. Appl. No. 15/988,021.

Search Report and Written Opinion for PCT/US2018/034310 dated Aug. 17, 2018.

Davis, D. et al., "Self-folding of polymer sheets using microwaves and graphene ink," Royal Society of Chemistry Advances, 5, pp. 89254-89261 (Oct. 15, 2015).

Liu, Y., et al., "Three-dimensional folding of pre-strained polymer sheets via absorption of laser light," American Institute of Physics, J. of Applied Physics, vol. 115, No. 20, pp. 204911-1-204911-6 (May 28, 2014).

All Office Actions, U.S. Appl. No. 16/718,924.

Definition of While, Merriam-Webster Dictionary, retrieved from URL https://www.merriam-webster.com/dictionary/ while on Apr. 24, 2020 (Year: 2020).

Picnic Basket Buying Guide, available online by Apr. 23, 2016, retrieved from URL https://web.archive.org/web/20160423090801/https://www.thepicnicworld.com/picnic-basket-buying-guide/ on Apr. 23, 2020 (Year: 2016).

Unpublished U.S. Appl. No. 17/150,073, filed Jan. 15, 2021, to O'Donnell Hugh Joseph et al.

* cited by examiner

FLEXIBLE PACKAGES WITH FLAT PANELS

FIELD

The present disclosure relates in general to flexible packages and in particular to flexible packages with flat panels.

BACKGROUND

Packages for consumer products often have external artwork that includes graphics, such as images and branding. However, there are certain challenges to effectively displaying such graphics. Flexible packages use less material and are less expensive, but are prone to wrinkling, which can cause artwork on the packages to have a poor appearance.

DETAILED DESCRIPTION

Flexible packages of the present disclosure include reinforcing areas that at least assist in reducing the amplitude and frequency of wrinkling in flexible materials and improving the flatness of package panels, such that the packages have an improved appearance.

Figure 1:
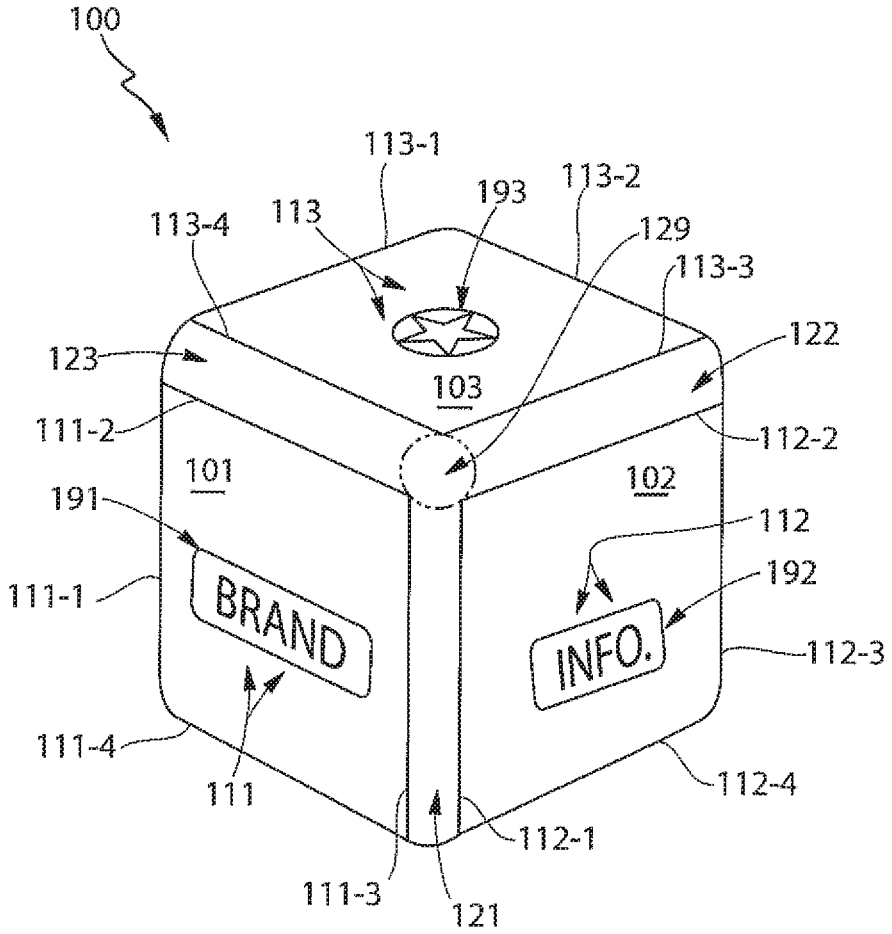
FIG. 1 illustrates an isometric view of a flexible package with reinforcing areas having straight edges.

FIG. 1 illustrates an isometric view of a flexible package 100, having an overall shape similar to a cuboid, standing upright on a horizontal support surface (not shown). The package 100 includes a first panel 101, a second panel 102, and a third panel 103.

The first panel 101 is made from one or more flexible materials, forms a face of the package 100, and is about flat. The panel 101 has an overall shape like a square and includes a plurality of outer edges, which together form a periphery of the panel 101. A reinforcing area 111 is disposed on an exterior of the panel 101, with the outer extents of the reinforcing area 111 coinciding with the periphery. The reinforcing area 111 has a first side 111-1, a second side 111-2, a third side 111-3, and a fourth side 111-4; each side of the reinforcing area 111 is continuous and straight, and the reinforcing area is shaped like a square. The exterior of the panel 101 also includes a graphic that is branding 191 disposed on a portion of the panel 101 that is surrounded by the reinforcing area 111.

The presence and location of the reinforcing area 111 increases the stiffness of the first panel 101 and at least assists in controlling the shape of the flexible material(s) that form the first panel 101. In particular, the reinforcing area 111 reduces buckling and/or wrinkling in the flexible material(s), more clearly defines the overall shape of the first panel 101 (consistent with its design), and contributes to improved flatness on the outside surface of the package 100. As a result, the first panel 101 has a better appearance and the branding 191 on the reinforcing area 111 is more easily recognized. These same benefits can be similarly realized on other panels of flexible materials with reinforcing areas, such as the second panel 102 and the third panel 103.

The second panel 102 is made from the one or more flexible materials, forms another face of the package 100, is square shaped and about flat, and has a square shaped continuous reinforcing area 112 with four straight sides 112-1, 112-2, 112-3, and 112-4 disposed on its exterior around its entire periphery, with a graphic that is information 192 disposed on a portion of the panel 102 that is surrounded by the reinforcing area 112. The reinforcing area 112 provides increased stiffness and control of the flexible material(s), such that the second panel 102 has a better appearance and the information 192 on the reinforcing area 112 is more easily understood.

The third panel 103 is made from the one or more flexible materials, forms a top of the package 100, is square shaped and about flat, and has a square shaped continuous reinforcing area 113 with four straight sides 113-1, 113-2, 113-3, and 113-4 disposed on its exterior around its entire periphery, with a graphic that is a logo 193 disposed on a portion of the panel 103 that is surrounded by the reinforcing area 113. The reinforcing area 113 provides increased stiffness and control of the flexible material(s), such that the third panel 103 has a better appearance and the logo 193 on the reinforcing area 113 is more easily perceived.

The first panel 101 and the second panel 102 are disposed on adjacent faces of the package 100, such that the first panel 101 and the second panel 102 are angled with respect to each other. On the first panel 101, the vertically oriented side 111-3 (of the reinforcing area 111) that is closest to the second panel 102 is disposed along an inboard edge of the first panel 101. On the second panel 102, the vertically oriented side 112-1 (of the reinforcing area 112) that is closest to the first panel 101 is disposed along an inboard edge of the second panel 102. These sides 111-3 and 112-1, which are disposed along the inboard edges, are parallel with each other.

In between the sides 111-3 and 112-1 is a first radiused edge 121, made from the one or more flexible materials. The first radiused edge 121 is free of any reinforcing elements (e.g. reinforcing lines, reinforcing areas). Since the first radiused edge 121 is free of any reinforcing elements, the flexible material(s) are allowed to bend around the angle between the first panel 101 and the second panel 102 without resistance from a stiffening structure. As a result, the first radiused edge 121 has an overall shape that is continuously curved between the first panel 101 and the second panel 102. The flexible material(s) of the first radiused edge 121 can have a smooth surface even while bending with a relatively tight radius. As a result, the first radiused edge 121 is attractive and well defined. These same benefits can be similarly realized on other radiused edges of flexible materials that are free of reinforcing elements, such as a second radiused edge 122 and a third radiused edge 123.

The second panel 102 and the third panel 103 are disposed on adjacent faces of the package 100, and are angled with respect to each other, with the closest sides 112-2 and 113-3 (of their respective reinforcing areas 112 and 113) parallel with each other, and the second radiused edge 122 disposed in between, wherein the second radiused edge 122 is free of reinforcing elements, such that the second radiused edge 122 is attractive and well defined.

The first panel 101 and the third panel 103 are disposed on adjacent faces of the package 100, and are angled with respect to each other, with the closest sides 111-2 and 113-4 (of their respective reinforcing areas 111 and 113) parallel with each other, and the third radiused edge 123 disposed in between, wherein the third radiused edge 123 is free of reinforcing elements, such that the third radiused edge 123 is attractive and well defined.

The first radiused edge 121, the second radiused edge 122, and the third radiused edge 123 all come together at a radiused corner 129, which is a vertex on the overall cuboid shape of the package 100. The corner 129 is disposed in between the corners of the first panel 101, the second panel 102, and the third panel 103, and is shown as the area encircled by a phantom line in FIG. 1. The radiused corner 129 is free of any reinforcing elements. Since the radiused corner 129 is free of any reinforcing elements, the flexible material(s) are allowed to bend around the angles between the first panel 101, the second panel 102, and the third panel 103 without resistance from a stiffening structure. As a result, the radiused corner 129 has an overall shape that is continuously curved between the first panel 101, the second panel 102, and the third panel 103. The flexible material(s) of the radiused corner 129 can have a smooth surface even while bending with relatively tight radii. As a result, the radiused corner 129 is attractive and well defined. These same benefits can be similarly realized on other radiused corners of flexible materials that are free of reinforcing elements.

Figure 2:
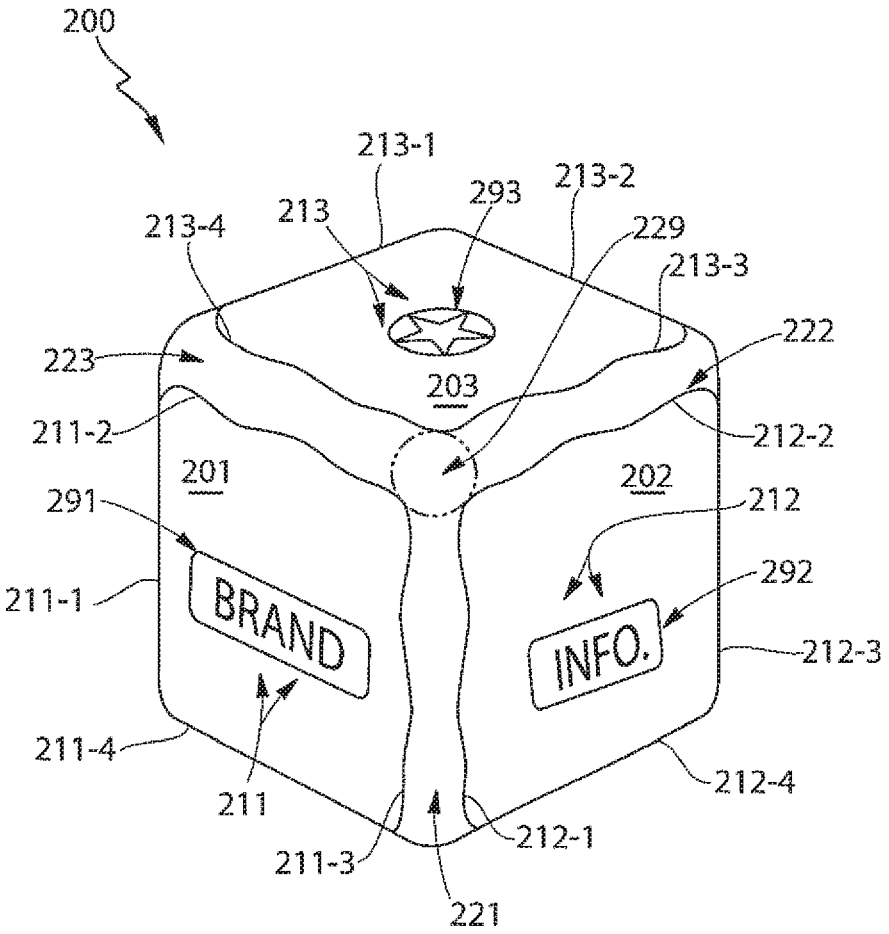
FIG. 2 illustrates an isometric view of a flexible package with reinforcing areas having non-linear edges.

FIG. 2 illustrates an isometric view of a flexible package 200, which is the same as the flexible package 100, with the elements of FIG. 2 configured in the same way as like-numbered elements of FIG. 1, except as described below. Each of the reinforcing areas 211, 212, and 213 has non-linear sides (211-1 through 213-4), but has a location and overall orientation that is about the same (respectively) as the location and orientation of the corresponding reinforcing area of FIG. 1. Although the sides of the reinforcing areas 211, 212, and 213 are not straight, for the closest reinforcing areas on adjacent panels, the overall orientations of those sides are parallel with each other (wherein each overall orientation is taken linearly from end-to-end). As a result, the panels 201, 202, and 203 experience the same benefits as the panels of FIG. 1, the radiused edges 221, 222, and 223 experience the same benefits as the radiused edges of FIG. 1, and the radiused corner 229 experiences the same benefits as the radiused corner of FIG. 1.

Figure 3:
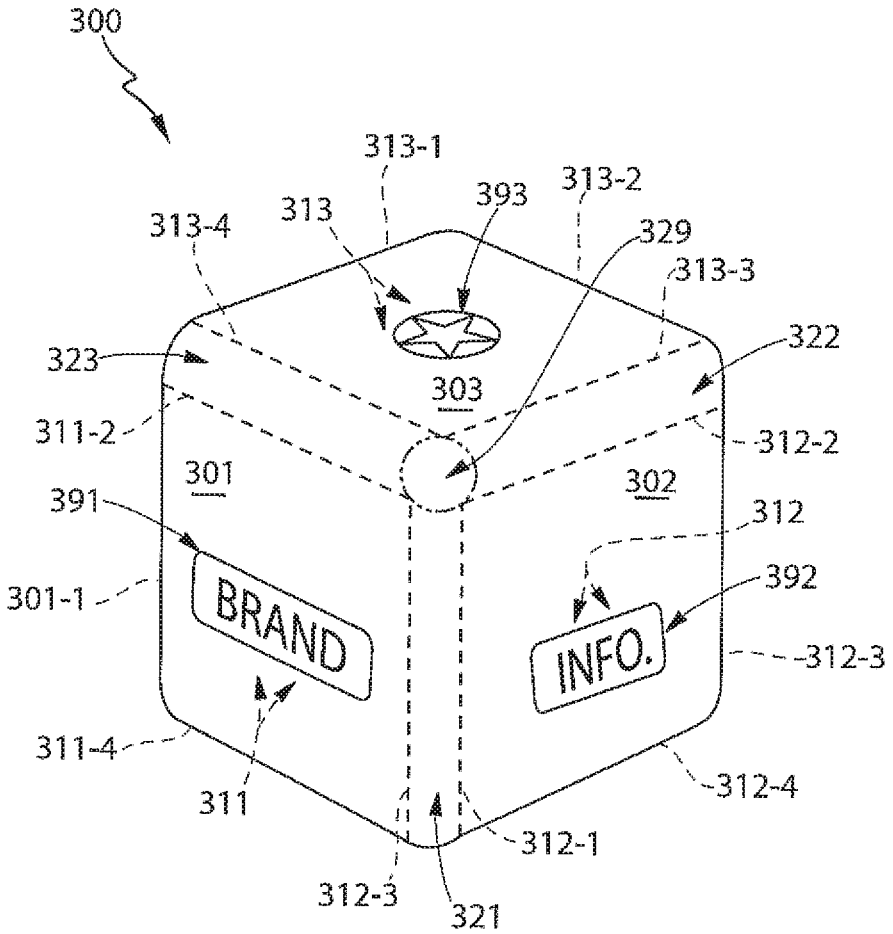
FIG. 3 illustrates an isometric view of a flexible package with interior reinforcing areas.

FIG. 3 illustrates an isometric view of a flexible package 300, which is the same as the flexible package 100, with the elements of FIG. 3 configured in the same way as like-numbered elements of FIG. 1, except as described below. Each of the reinforcing areas 311, 312, and 313 is disposed on the interior of its panel 301, 302, and 303 but otherwise has a location and orientation that is the same (respectively) as the location and orientation of the corresponding reinforcing area of FIG. 1. As a result, the panels 301, 302, and 303 experience the same benefits as the panels of FIG. 1, the radiused edges 321, 322, and 323 experience the same benefits as the radiused edges of FIG. 1, and the radiused corner 329 experiences the same benefits as the radiused corner of FIG. 1.

Any of the embodiments disclosed herein may be created and/or modified according to any of the following, in any workable combination. A flexible package may have any size, shape, or configuration, including any number of panels, disposed at any relative angle from 1 degree to 180 degrees (wherein for 180 degrees, the panels are parallel with each other, disposed on opposite sides of the package), and configured according to any embodiment for a panel disclosed herein. Any panel may have any size, shape, or configuration, and may be made from one or more of any flexible materials disclosed herein or known in the art. Part, parts, or all of any panel may have varying degrees of flatness, and may be about flat, approximately flat, substantially flat, nearly flat, or completely flat, as defined and described herein. A flexible package may include any number of panels configured in the same way, or in similar ways, or in different ways, according to any embodiments disclosed herein.

Any reinforcing area may be formed in any way described herein or known in the art. Any reinforcing area may be made from one or more curable coatings, including photopolymers such as mixtures of monomers, oligomers, and/or photoinitiators; common forms include acrylates and silicones; such photopolymers are curable into a hardened state by exposure to heat and/or light (visible and/or ultraviolet), as known in the art. In various embodiments, any reinforcing area may made from various polymers, such as thermoplastics and/or thermosets. Any reinforcing area may be disposed on a flexible material by any suitable process, such as: gravure printing, inkjet printing, screen printing, and flexographic printing; these processes may also be used to impart a smooth outer surface or a rough/textured outer surface to a reinforcing area. Any reinforcing area may be disposed on a flexible material directly or indirectly (e.g. onto a printed label or overwrap that is applied to the flexible package).

Part, parts, or all or any reinforcing area may have any size and/or shape described herein or known in the art. Part, parts, or all of a reinforcing area may have an overall height from 40 to 5000 microns, or any integer value for microns from 40 to 5000, or any range formed by any of these values, such as, 40-4000 microns, 1000-3000 microns, 2000-4000 microns, etc. Part, parts, or all of a reinforcing area may have any convenient overall width and any convenient overall length.

Sides of reinforcing areas disposed along inboard edges of adjacent panels may or may not be parallel with each other. As examples, these sides may have any relative orientation from 30 degrees out of parallel to completely parallel, or out of parallel by any integer value for degrees from 1 to 30 degrees, or any range formed by any of these values, such as within 20 degrees of parallel, within 10 degrees of parallel, or within 5 degrees of parallel.

Reinforcing areas may be disposed in various ways and to various extents on a panel made from flexible material(s), as described herein. The sides of a reinforcing area may be disposed on the panel along 50 to 100% of the periphery of the panel, or any integer value for percentage between 50 and 100, such as 60-100%, 70-100%, 80-100%, or 90-100%. Sides of a reinforcing area may be disposed along the entire periphery of the panel. The reinforcing areas disposed on a panel may cover 15 to 100% of the total surface area of the panel, or any integer value for percentage between 15 and 100, such as 15-35%, or 20-30%.

For any portion of a flexible package described as free of reinforcing elements, in various alternative embodiments, some limited presence of reinforcing elements may be included on that portion, as described below. Such portions may include: part, parts, or all of a radiused edge between panels and/or part, parts, or all of a radiused corner between panels. One or more reinforcing lines/areas may be disposed on such portions, so long as such portions are 75 to 100% free of reinforcing elements, or any integer value for percentage between 75 and 100, such as 80-100% free, 85-100% free, 90-100% free, or 95-100% free. Such portions may also be completely free of any reinforcing elements (e.g. reinforcing lines, reinforcing areas).

Definitions

As used herein, when the term "about" modifies a particular value, the term refers to a range equal to the particular value, plus or minus twenty percent (+/−20%). For any of the embodiments disclosed herein, any disclosure of a particular value, can, in various alternate embodiments, also be understood as a disclosure of a range equal to about that particular value (i.e. +/−20%). As used herein, when the term "about" refers to the straightness of a side of a reinforcing area, the phrase "about straight" means that, when the reinforcing area is removed from a package (as defined herein) and laid out flat on a clean, smooth, flat horizontal surface (like a desktop), the entire side fit between two flat parallel lines set apart by a separation distance that is equal to 20% of the overall length of the side. As used herein, when the term "about" refers to the flatness of a panel, the phrase "about flat" means that, when the panel is part of a package configured for retail sale and is otherwise undistorted, the panel fits between two parallel planes set apart by a separation distance that is equal to the average overall thickness of the panel plus 20 millimeters.

As used herein, when the term "approximately" modifies a particular value, the term refers to a range equal to the particular value, plus or minus fifteen percent (+/−15%). For any of the embodiments disclosed herein, any disclosure of a particular value, can, in various alternate embodiments, also be understood as a disclosure of a range equal to approximately that particular value (i.e. +/−15%). As used herein, when the term "approximately" refers to the straightness of a side of a reinforcing area, the phrase "approximately straight" means that, when the reinforcing area is removed from a package (as defined herein) and laid out flat on a clean, smooth, flat horizontal surface (like a desktop), the entire side fits between two flat parallel lines set apart by a separation distance that is equal to 15% of the overall length of the side. As used herein, when the term "approximately" refers to the flatness of a panel, the phrase "approximately flat" means that, when the panel is part of a package configured for retail sale and is otherwise undistorted, the panel fits between two parallel planes set apart by a separation distance that is equal to the average overall thickness of the panel plus 15 millimeters.

As used herein, the term "flexible package" refers to a package, wherein one or more flexible materials form from 50 to 100% of the total mass of the package, or any integer value for percentage from 50 to 100, or any range formed by any of these values, such as 50-88%, 50-80%, 50-70%, 50-63%, 63-88%, 70-80%, 63-100%, 70-100%, 80-100%, or 88-100% of the total mass of the package.

As used herein, the term "flexible material" refers to a thin, easily deformable, sheet-like material, having a flexibility factor within the range from 1,000 to 2,500,000 N/m, or any integer value for N/m from 1,000 to 2,500,000, or any range formed by any of these values, such as 1,000 to 1,250,500 N/m, 100,000 to 1,250,500, 1,250,500-2,500,000 N/m, etc. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, with or without one or more of any suitable additives (such as perfumes, dyes, pigments, particles, agents, actives, fillers, etc.) and in any combination, as described herein or as known in the art.

As used herein, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, the term "graphic" refers to a visual representation of an element intended to provide a decoration or to communicate information. Examples of graphics include one or more of any of the following: colors, patterns, designs, images (e.g. photographs, drawings, or other renderings), characters, branding, logos, information, and the like. For any embodiment disclosed herein (including any alternative embodiments), any surface of the package, including any panel(s), can include one or more graphics of any size, shape, or configuration, disclosed herein or known in the art, in any combination.

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with differing leading digit(s), wherein that leading digit(s) matches the number for its Figure; as an example, an element of FIG. 3 labeled 320 and an element of FIG. 4 labeled 420 are like-numbered. Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, the term "reinforcing area" refers to a physical structure disposed in or on a flexible material, having one or more sides that define its outer extent. Part, parts, or all of any reinforcing area can be any convenient shape. A reinforcing area may be formed by a plurality of reinforcing structures (e.g. print), which may be unitary or discontinuous, patterned or unpatterned, over part, parts, or all of the reinforcing area. In various embodiments, 50-100% of a reinforcing area may be continuous (i.e. interconnected), or any integer value for percentage between 50 and 100 may be continuous, such as 50-90%, 50-80%, 50-70%, or 50-60%. A reinforcing area may be disposed on an exterior of a flexible material on an outward facing surface of the package, or a reinforcing area may be disposed interior to a flexible material on an inward facing surface of the package; when disposed interior to a flexible material, the reinforcing area may be disposed within a flexible material (e.g. embedded), may be disposed in between multiple flexible materials that are connected over their faces (e.g. a laminate), or may be disposed between multiple flexible materials that are not connected over their faces (e.g. disposed interior to one flexible material, but exterior to another flexible material).

As used herein, the term "removed from the package" means removing a reinforcing area from a flexible package according to the description in this paragraph. Removal includes cutting out (e.g. by using scissors) a continuous portion of the package that includes the reinforcing area. The cutting out must not damage the portion in any way and also must not deform the portion in any way that would permanently distort its shape or limit its ability to lay flat. The removal must entirely separate the continuous portion from the rest of the package. The continuous portion of the package must include all of the reinforcing area that is being measured. The continuous portion of the package must not include any structural features besides the reinforcing area and the flexible material(s). The flexible material within the continuous portion must not include any discontinuities from the package structure such as creases, seams, seals, joints, weld lines, or the like. The continuous portion must include portions of the flexible material(s) directly attached to the reinforcing area as well as the adjoining portions of the flexible material(s) that surround the reinforcing area. The surrounding portions must extend 5-20 millimeters away from the reinforcing area, in all directions, unless there is an obstruction (such as a structural feature or discontinuity in the film) that is less than 5 millimeters away from the reinforcing area, in which case the surrounding portion should be cut as close to the obstruction as possible, without including any part of the obstruction. The continuous portion must be cut so that the cut edge is clean, smooth, and continuous, without any sharp corners, rough breaks, or ragged edges. If, during removal, a section of flexible material naturally separates (e.g. falls off) from the portion with the reinforcing area, then the separated section is discarded and not included in any measurement or assessment of the reinforcing area.

As used herein, when the term "nearly" modifies a particular value, the term refers to a range equal to the particular value, plus or minus five percent (+/−5%). For any of the embodiments disclosed herein, any disclosure of a particular value, can, in various alternate embodiments, also be understood as a disclosure of a range equal to approximately that particular value (i.e. +/−5%). As used herein, when the term "nearly" refers to the straightness of a side of a reinforcing area, the phrase "nearly straight" means that, when the reinforcing area is removed from a package (as defined herein) and laid out flat on a clean, smooth, flat horizontal surface (like a desktop), the entire side fits between two flat parallel lines set apart by a separation distance that is equal to 5% of the overall length of the side. As used herein, when the term "nearly" refers to the flatness of a panel, the phrase "nearly flat" means that, when the panel is part of a package configured for retail sale and is otherwise undistorted, the panel fits between two parallel planes set apart by a separation distance that is equal to the average overall thickness of the panel plus 5 millimeters.

As used herein, the term "panel of flexible material" refers to a portion of an outside surface of a flexible package, wherein the portion is bounded by folds, curves, seams, and/or edges, such that the bounded portion is configured to substantially face a particular overall direction. Any of the embodiments of reinforcing areas can be disposed on one or more of any panels of any package disclosed herein or known in the art, including a front panel, a back panel, a side panel, a top panel, and a bottom panel.

As used herein, when referring to a packages, the term "configured for retail sale" refers to a package that is fully manufactured and its product space(s) is/are filled with product(s) and the package is fully closed and/or sealed and the package is in condition to be purchased by an end user (e.g. a consumer), through any sales and/or distribution channel, wherein the package has not been opened or unsealed, and wherein the product(s) in the package have not been put into its/their intended end use. Any package disclosed herein (including any alternative embodiments) can be configured for retail sale.

As used herein, when the term "substantially" modifies a particular value, the term refers to a range equal to the particular value, plus or minus ten percent (+/−10%). For any of the embodiments disclosed herein, any disclosure of a particular value, can, in various alternate embodiments, also be understood as a disclosure of a range equal to approximately that particular value (i.e. +/−10%). As used herein, when the term "substantially" refers to the straightness of a side of a reinforcing area, the phrase "substantially straight" means that, when the reinforcing area is removed from a package (as defined herein) and laid out flat on a clean, smooth, flat horizontal surface (like a desktop), the entire side fits between two flat parallel lines set apart by a separation distance that is equal to 10% of the overall length of the side. As used herein, when the term "substantially" refers to the flatness of a panel, the phrase "substantially flat" means that, when the panel is part of a package configured for retail sale and is otherwise undistorted, the panel fits between two parallel planes set apart by a separation distance that is equal to the average overall thickness of the panel plus 10 millimeters.

The packages described herein, may be used across a variety of industries for a variety of products. For example, any embodiment of a package, as described herein may be used for receiving, containing, storing, and/or dispensing any product in the consumer products industry. Although the present disclosure describes its embodiments with respect to consumer products, they can also be similarly applied outside of the consumer products industry.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible package for retail sale of a consumer product, the package comprising:

a first panel formed of a flexible film and comprising a first plurality of outer edges and a first reinforcing area disposed inboard of the first plurality of outer edges, wherein the first reinforcing area comprises a first plurality of reinforcing elements, wherein the first reinforcing area is disposed between two layers of material of the flexible film of the first panel;

a second panel formed of the flexible film and comprising a second plurality of outer edges and a second reinforcing area disposed inboard of the second plurality of outer edges, wherein the second reinforcing area comprises a second plurality of reinforcing elements, and wherein the second reinforcing area is disposed between the two layers of the material of the flexible film of the second panel; and a radiused edge formed of the flexible film, wherein the radiused edge is disposed between the first reinforcing area and the second reinforcing area, and wherein the radiused edge is substantially free of the first and second pluralities of reinforcing elements.

2. The flexible package of claim 1, wherein each of the first panel and the second panel are substantially flat and comprise a portion adapted to include a graphic, and wherein each of the first reinforcing area and the second reinforcing area, respectively, surround the portions of the first panel and the second panel.

3. The flexible package of claim 1, wherein the first reinforcing area covers between about 15% and about 35% of the first panel, wherein the second reinforcing area covers between about 15% and about 35% of the second panel, and wherein the first reinforcing elements and the second reinforcing elements are not located in portions of the panel and the second panel that are adapted to include a graphic.

4. The flexible package of claim 1, wherein the first panel and the second panel are disposed on adjacent faces of the flexible package.

5. The flexible package of claim 4, wherein the first reinforcing area comprises a first vertically oriented side disposed adjacent to the second panel, and wherein the first vertically oriented side is substantially straight.

6. The flexible package of claim 5, wherein the second reinforcing area comprises a second vertically oriented side disposed adjacent to the first panel, and wherein the second vertically oriented side is substantially straight.

7. The flexible package of claim 6, wherein the first vertically oriented side and the second vertically oriented side are within 10 degrees of parallel to each other.

8. The flexible package of claim 1, wherein the radiused edge forms a continuous curve between the first panel and the second panel.

9. The flexible package of claim 1, wherein the first reinforcing area and the second reinforcing area are disposed on an inside surface of the flexible package.

10. The flexible package of claim 1, wherein the first reinforcing area and the second reinforcing area are disposed on an outside surface of the flexible package and the first reinforcing elements and the second reinforcing elements are not located in portions of the panel and the second panel intended to include a graphic.

11. A flexible package for retail sale of a consumer product, the package comprising:

a first panel formed of a flexible film and comprising a first plurality of outer edges, wherein the first panel comprises a first reinforcing area offset from the first plurality of outer edges, wherein the first reinforcing area is disposed between two layers of material of the flexible film of the first panel;

a second panel formed of the flexible film and comprising a second plurality of outer edges, wherein the second panel comprises a second reinforcing area offset from the second plurality of outer edges, wherein the second reinforcing area is disposed between the two layers of the material of the flexible film of the second panel; and a radiused edge formed of the flexible film, wherein the radiused edge is disposed between the first reinforcing area and the second reinforcing area.

12. The flexible package of claim 11, wherein the first panel is substantially flat and a portion of the first panel is adapted for a graphic, and wherein the first reinforcing area surrounds the portion of the first panel and does not include a graphic.

13. The flexible package of claim 11, wherein the second panel is substantially flat and a portion of the second panel is adapted for a graphic, and wherein the second reinforcing elements surrounds the portion of the second panel and does not include a graphic.

14. The flexible package of claim 11, wherein the first reinforcing area covers between about 15% and about 35% of the first panel.

15. The flexible package of claim 11, wherein the second reinforcing area covers between about 15% and about 35% of the second panel.

16. The flexible package of claim 11, wherein the first panel and the second panel are disposed on adjacent faces of the flexible package.

17. The flexible package of claim 16, wherein the first reinforcing area comprises a first vertically oriented side disposed adjacent to the second panel, and wherein the first vertically oriented side is substantially straight.

18. The flexible package of claim 17, wherein the second reinforcing area comprises a second vertically oriented side disposed adjacent to the first panel, and wherein the second vertically oriented side is substantially straight.

19. The flexible package of claim 18, wherein the first and second vertically oriented sides are within 10 degrees of parallel of each other.

20. The flexible package of claim 11, comprising:

a third panel formed of the flexible film and comprising a third plurality of outer edges, wherein the third panel comprises a third reinforcing area offset from the third plurality of outer edges, wherein the third reinforcing area is disposed between the two layers of the material of the flexible film of the third panel;

a second radiused edge formed of the flexible film, wherein the second radiused edge is disposed between the first reinforcing area and the third reinforcing area; and a third radiused edge formed of the flexible film, wherein the third radiused edge is disposed between the second reinforcing area and the third reinforcing area;

wherein the first radiused edge, the second radiused edge, and the third radiused edge meet at a radiused corner.

* * * * *